United States Patent [19]

Allen

[11] 4,280,169

[45] Jul. 21, 1981

[54] FLUORESCENT LAMP END CAP

[76] Inventor: Carl J. Allen, 16272 Glynn Rd., East Cleveland, Ohio 44112

[21] Appl. No.: 60,367

[22] Filed: Jul. 25, 1979

[51] Int. Cl.[3] ..... F21S 3/00

[52] U.S. Cl. ..... 362/217; 362/376

[58] Field of Search ..... 362/217, 376

[56] References Cited

U.S. PATENT DOCUMENTS 3,892,457 7/1975 Detch et al. ..... 362/217

*Primary Examiner*—Stephen J. Lechert, Jr.

*Attorney, Agent, or Firm*—Baldwin, Egan, Walling & Fetzer

[57] ABSTRACT

A decorative and lockable end cap for fluorescent lamps in the form of an enclosure which covers and conceals the base of the fluorescent lamp and its lampholder, whereby enhancing the appearance of bare bulb fluorescent lamp luminaires, thus improving their acceptance as energy conservation lighting fixtures and also deterring lamp theft when the fixtures are located within easy reach in public places.

8 Claims, 10 Drawing Figures

10

FLUORESCENT LAMP END CAP

BACKGROUND OF THE INVENTION

Heretofore various forms of end cap enclosures have been available to cover the ends of fluorescent lamps and their lampholders to make bare lamp fluorescent luminaires more esthetically acceptable.

U.S. Pat. No. 2,345,982 is a patent directed to a structure known to the present inventor of such prior art and which is directed to a device designed to cover the end of a fluorescent lamp and its lampholder.

This prior art device has been found to be unsatisfactory and inadequate in two respects. One is this prior art device depends upon a tension clamping action and when it is applied to a fluorescent lamp it can scratch the glass bulb and result in a dangerous bulb implosion. The other is that the device covers a significant section of the luminous part of the bulb and results in a loss of useful light.

The present invention overcomes these deficiencies of the prior art as the end cap does not touch the glass part of the bulb. It, also, covers only the non-luminous base of the lamp so that all of the lamp's light output is available for useful lighting purposes.

Further, as will be hereinafter more readily apparent, the lockable feature of the present invention deters the theft of lamps especially where a bare lamp fixture is used at an easily reached location as on the walls of an apartment or hotel corridor.

The benefit of this present invention lies in its potential for making bare lamp fluorescent luminaires more esthetically acceptable as replacements for incandescent luminaires. It is well known that fluorescent lighting only takes one-half to one-fourth the electricity required by comparable incandescent lighting.

This present invention, while applicable to a broad field of applications is best illustrated as to its value toward energy conservation as in the lighting of apartment interior corridors where incandescent lighting is currently the principal form of light. Typically sixty watt long-life incandescent lamps are used consuming approximately 525 kilowatt-hours per year as they are on continuously for 8760 hours. A bare 15 watt fluorescent fixture which consumes 20 watts with its ballast only uses about 175 kilowatt-hours and gives about the same amount of light. Thus if such a sixty watt incandescent fixture can be replaced with a 15 watt fluorescent fixture the savings in energy would amount to 350 kilowatt-hours per year for each fixture replaced. The basic reason such replacements have not been widely done is that bare lamp fluorescent luminaires of acceptable pleasing appearance have not been available. The fluorescent lamp's cylindrical shape is basically pleasing but the appearance of the lamp base and the lampholder is not as esthetically acceptable. The end cap of this invention by covering the lamp base and the lampholder with a pleasing appearing structure makes the use of bare lamp fluorescent fixtures more acceptable especially where they can be viewed at close range and thus permit the energy conservation benefits of fluorescent lighting to be more widely used.

SUMMARY OF THE INVENTION

The end cap of the present invention comprises a structure which has a cylindrical cross section that accommodates and encircles the base of a fluorescent lamp and a rectangular cross section cavity which accommodates and encloses the lamp holding structure of a fluorescent lampholder when the lamp and the end cap are placed over the lampholder. Neither the lamp enclosing cavity or the lampholder cavity are tight fits and the end cap is secured loosely to the lamp and lampholder by the locking action of the lamp being inserted in the lampholder. The end cap conceals the end structure of the fluorescent lamp and its lampholder and being of a pleasing functional appearance it enhances the appearance of bare fluorescent luminaires.

Further, if additional security from lamp theft is desired, a locking device in the form of a set screw with a pin extension can be threaded into a hole formed in the back end wall of the end cap so that the pin extension is engaged in a hole formed in the back of the lampholder and in line with the axial center of the lamp when it is inserted in the lampholder. This pin locks the end cap to the lampholder so that the end cap is restricted from being lifted off of the lamp holder and thus prevents the lamp from being removed. The set screw may also be provided with a hex socket in its head so that a small hex wrench, which is not commonly available, is needed to unlock the end cap from the lampholder.

Further, the end cap is designed so that its structure does not touch the glass bulb so that the possibility of scratching the glass with the end cap and causing a hazardous bulb implosion is not present.

Further, the end cap covers only the non-luminous part of the lamp, thus the full light output is available.

DESCRIPTION OF THE PREFERRED EMBODIMENTS

Figure 1:
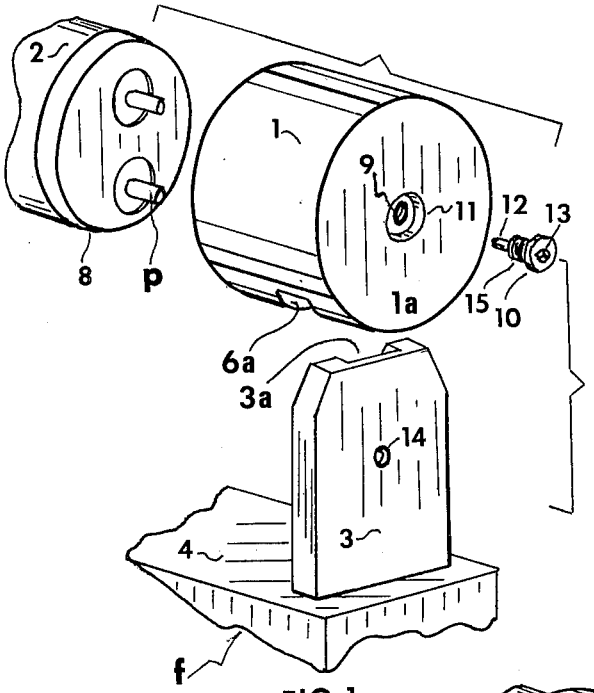
FIG. 1 is an end perspective view of the fluorescent lamp end cap showing a typical fluorescent lamp and its lampholder, as an exploded view, together with the locking set screw.

Referring now to the drawings, the end cap, for purposes of illustration, is shown as being used with a typical bare lamp fluorescent fixture F having a medium bipin based fluorescent lamp 2 and a pair of medium bipin lampholders 3 mounted on the fixture housing 4 between which said lamp 2 is suspended. As will be understood in the art and more fully explained hereinafter, the end cap of the present invention is also adaptable for use with the several other types of fluorescent lamp fixtures such as those using miniature bipin, mogul bipin, single pin and recessed double contact bases.

Figure 2:
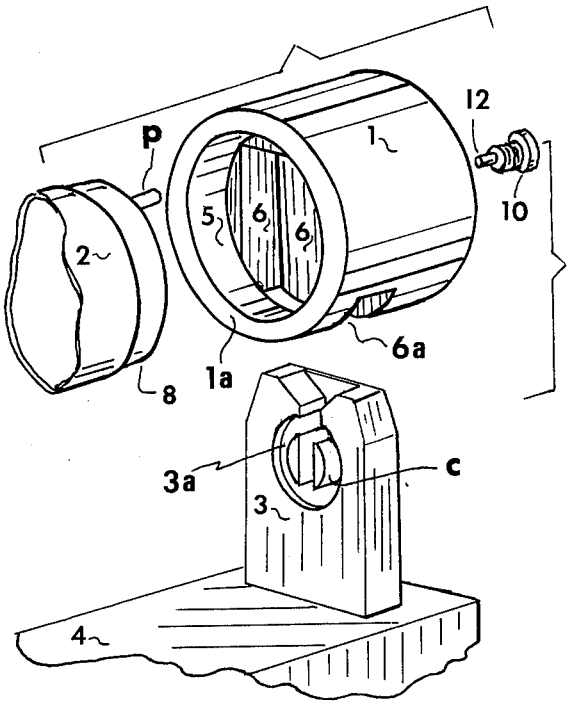
FIG. 2 is an exploded perspective view showing the cylindrical cavity for the lamp and the rectangular prismoidal cavity for the lampholder.
Figure 3:
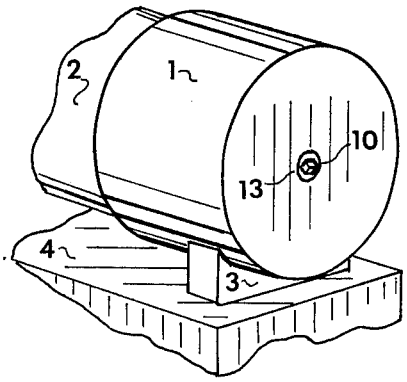
FIG. 3 is an end perspective view showing the end cap in place and surrounding and enclosing the base of the fluorescent lamp and the lamp holding structure of the lampholder with the locking set screw threaded into the back of the end cap.
Figure 4:
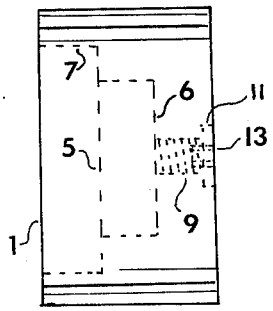
FIG. 4 is a top view of the end cap showing the cylindrical cavity for the lamp, the rectangular cross section cavity for the lampholder, and the threaded hole for the locking set screw.

As best seen in FIGS. 1, 2 and 3, the end cap of the present invention in its illustrated embodiment, is identified in its entirety at 1, and has a generally cylindrical body in outer contour having inner and outer end walls 1*a* disposed at 90° degrees to the axis of the cylinder.

As best seen in FIG. 2, the end cap is formed with a cylindrical cavity or recess 5 which extends from its open end at the inner end wall 1*a* of said cap axially and into said cap. Said cavity has a diameter preferably slightly larger than the diameter of the base 8 of the fluorescent lamp 2 with which it is intended to be used so that the base of said lamp may be easily inserted into the same. The axial depth of cavity 5 is perferably equal to the axial length of the lamp's base 8 less the length of the lamp contact pins p.

Figure 5:
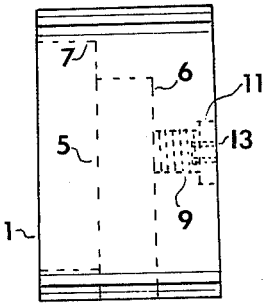
FIG. 5 is a side view showing the cylindrical cavity, the open bottom cavity for the lampholder and the hole for the set screw.
Figure 6:
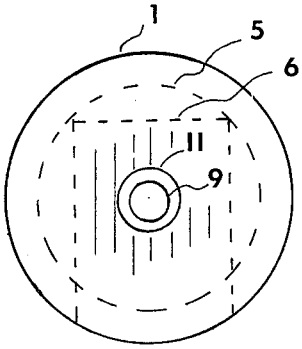
FIG. 6 is an end view of the assembly illustrated in FIG. 4.
Figure 9:
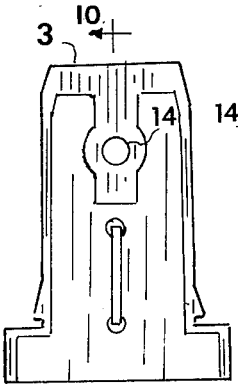
FIG. 9 is an end view of a typical medium bipin lampholder modified with a hole formed in the back structure of the lampholder.
Figure 10:
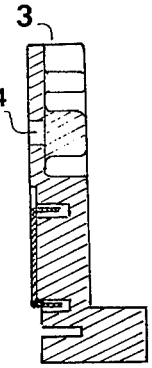
FIG. 10 is a sectional view taken on line 10—10 of FIG. 9.

A rectangular prismoidal cavity 6 is formed in the end cap extending perpendicular to the axis thereof and with its wide side wall 6*b* being transverse of the axis, said cavity 6 being located in axial juxtaposition to cavity 5 and communicating therewith at its inner end as best seen in FIG. 5, and exiting radially outwardly to the exterior at 6*a*. Said cavity 6 has a cross sectional dimension that is slightly larger than the cross sectional thickness of the lampholder 3.

Each lampholder 3, in its illustrated form is generally rectangular in cross section, being attached to the surface of the housing 4 extending perpendicularly from said surface and having a recess 3*a* into which the pins p on one end of the lamp 2 are moved and into resilient engagement with electrical power contacts disposed internally in the lampholder 3 which releasably secure said lamp in its electrical operative relationship suspended between said lampholders 3.

Figure 7:
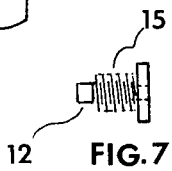
FIG. 7 is a side view of the locking set screw showing the pin extension, the threaded section and the head of the set screw.
Figure 8:
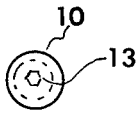
FIG. 8 is an end view of the set screw showing the recessed hex socket.

A threaded hole 9 is formed in the outer end wall 1*a* of the end cap and communicates with cavity 6. Said hole is recessed centrally within circular cavity 11 into which is disposed the head of a locking set screw 10 as seen in FIGS. 7 and 8 when the fixture is fully assembled.

With reference to FIGS. 1, 2 and 3, the bare lamp fixture F is assembled by placing end caps 1 over both ends of the fluorescent lamp 2 with the lamp bases 8 inserted into end cap cavities 5 and with the pins p of the lamp lined up so as to enter the opening of the lampholders 3*a* and with the opening 6*a* to the prismoidal cavity 6 lined up with the lampholders as shown in FIG. 1. The end caps and the lamp assembly can then be placed onto the lampholders 3 and the lamp rotated sufficiently as will be understood in the art to move the pins into resilient engagement with the lampholder's internal contacts (not shown) to thus secure and suspend the lamp 2 between the lampholders 3.

In this manner, the end caps 1 are also secured in their assembled relationship so that they cannot be removed from the assembled fixture without also removing the lamp 2 from the lampholders 3.

When it is desired to secure the lamp against petty theft locking set screw 10 may be inserted into the threaded hole 9 in the back of the end cap 1 so that the pin extension 12 engages in hole 14 in the lampholder 3, which action prevents the end cap from being lifted off of the lampholder and secures the lamp from removal unless a hex headed wrench of the proper size is used at 13, to remove the set screw.

An end cap of the type herein described may be formed from any suitable material, such as for example plastic or ceramic. The locking set screw should be made of an insulating material such as nylon plastic.

The applicant herein has constructed a suitable end cap for use with a T12 bulb fluorescent lamp fixture with a medium bipin base and said end cap has an outside diameter of $1\frac{7}{8}$ inches and a length of $1\frac{1}{4}$ inches.

Having thus described one embodiment of end cap of the present invention, it is apparent that the external shape thereof is capable of being varied for purposes of appearance without departing from the inventive concept hereof as is defined in the claims.

I claim:

1. An end cap for use with a fluorescent lamp fixture having spaced lampholder means between which a fluorescent lamp is suspended, said end cap comprising a body having a first cavity formed therein and opening to one end of said body, a second cavity formed in said body and connecting with said first cavity, said second cavity exiting to the exterior of said end cap and adapted to permit one of said lampholder means to be inserted therethrough and into said second cavity, each end of said lamp being inserted through said one end and into the first cavity of an end cap disposed over one of said lampholder means and releasably engageable therewith to secure said lamp end, lampholder means and end cap together.

2. In a fluorescent lamp fixture having spaced lampholder means between which a fluorescent lamp is suspended, said lamp and lampholder means having interconnecting contact means for providing electrical power to said lamp, an end cap mountable over each said lampholder means and comprising a body having a first cavity formed therein and opening to one end of said body, a second cavity formed in said body and connecting with said first cavity, said second cavity exiting to the exterior of one side surface thereof said end cap and adapted to permit one of said lampholder means to be inserted therethrough and into said second cavity, each end of said lamp being inserted through said one end and into the first cavity of one of said end caps and into releasable engagement with the lampholder means disposed in the second cavity associated therewith effective to interconnect said contact means and releasably secure said end cap, lamp and lampholder to each other and to enclose said lampholder means and contact means.

3. An end cap as is defined in claim 1 and which is cylindrical in overall configuration.

4. An end cap as is defined in claim 1 and wherein the second cavity projects through said cap in a direction substantially perpendicular to the axis thereof.

5. An end cap as is defined in claim 4 and wherein the second cavity is rectangular in configuration and the side wall thereof of greater dimension is disposed in a plane that is transverse of the axis of the cap.

6. An end cap as is defined in claim 5 and wherein the second cavity is configured to enable lampholder means to be slidably disposed therein.

7. A fluorescent lamp fixture as defined in claim 2 and wherein locking means interconnect with each of said end caps and its associated lampholder effective to releasably lock the same together.

8. A fluorescent lamp fixture as defined in claim 7 and wherein the locking means comprises screw means.

* * * * *